United States Patent [19]

Kadotani

[11] Patent Number: 4,869,088

[45] Date of Patent: Sep. 26, 1989

[54] RING SHAPING APPARATUS

[76] Inventor: Kazuo Kadotani, 28-45, Tojicho, Kokubu, Kashiwara-shi, Osaka, Japan

[21] Appl. No.: 214,167

[22] Filed: Jul. 5, 1988

[51] Int. Cl.[4] ..... B21H 1/12

[52] U.S. Cl. ..... 72/10; 72/102; 72/105; 72/106; 72/110

[58] Field of Search ..... 72/10, 102, 105, 106–108, 72/110, 111, 91

[56] References Cited

U.S. PATENT DOCUMENTS

| | | | |
|---|---|---|---|
| 3,345,845 | 10/1967 | Marcovitch et al. | 72/91 |
| 3,434,322 | 3/1969 | Cowles et al. | 72/107 |
| 3,681,962 | 8/1972 | Marcovitch | 72/106 |
| 3,698,218 | 10/1972 | Wieting | 72/111 |
| 3,824,820 | 7/1974 | Jeuken et al. | 72/110 |
| 4,454,739 | 6/1984 | Ciccorelli | 72/106 |
| 4,559,482 | 12/1985 | Fencl | 72/105 |

FOREIGN PATENT DOCUMENTS

| | | | |
|---|---|---|---|
| 212142 | 12/1984 | Japan | 72/110 |
| 1191158 | 11/1985 | U.S.S.R. | 72/110 |

*Primary Examiner*—Robert L. Spruill

[57] ABSTRACT

This invention relates to a ring shaping apparatus for cold rolling workpieces in ring form into a desired shape. The workpieces include a bearing in which an inner race, an outer race or a pillow is to be formed, a cage and a sleeve. The apparatus comprises a shaping roller, a mandrel and a support roller. Rotational rate of the support roller is controlled in response to variations in the diameter of a workpiece and in accordance with a rotational rate of the shaping roller. A pair of backup rollers in rotatable contact with peripheral surfaces of the workpiece under a constant pressure are interlocked to synchronously follow the variations in the diameter of the workpiece. Consequently, this apparatus is capable of shaping the workpiece with high precision with respect to roundness.

1 Claim, 5 Drawing Sheets

RING SHAPING APPARATUS

SUMMARY OF THE INVENTION

This invention relates to a ring shaping apparatus for cold rolling workpieces in ring form into a desired shape. The workpieces include a bearing in which an inner race, an outer race or a pillow is to be formed, a cage and a sleeve. The apparatus comprises a shaping roller, a mandrel and a support roller. Rotational rate of the support roller is controlled in response to variations in the diameter of a workpiece and in accordance with a rotational rate of the shaping roller. A pair of backup rollers in rotatable contact with peripheral surfaces of the workpiece under a constant pressure are interlocked to synchronously follow the variations in the diameter of the workpiece. Consequently, this apparatus is capable of shaping the workpiece with high precision with respect to roundness.

BACKGROUND OF THE INVENTION

An example of conventional ring shaping apparatus is disclosed in U.S. Pat. No. 3,803,890.

This apparatus comprises a mandrel disposed centrally of the apparatus for extending through a workpiece, four rolls for rotatably supporting the workpiece at outer peripheral positions thereof, and two shaping rolls one of which presses against the other to roll out the workpiece.

This known apparatus, however, has the disadvantage of necessitating a separate, complicated mechanism for rotating the mandrel reliably.

Furthermore, the known apparatus has the drawbacks of providing low rolling efficiency and having difficulties in shaping the workpiece with a high degree of roundness.

U.S. Pat. No. 1,720,833 discloses another example of ring shaping apparatus which includes a pair of backup rollers for rotatable pressure contact with peripheral surfaces of a workpiece. These backup rollers, however, are manually and individually controlled by means of handwheels, and the two backup rollers tend to apply unequal pressing forces to the workpiece. It is therefore impossible to shape the workpiece with a high degree of roundness. With this apparatus, a shaping operation must be followed by a sizing operation for finishing either the inside or outside of the workpiece to agree with a required size. The sizing operation involves press-fitting of the workpiece with a mold and, for processing a large workpiece, requires a large sizing apparatus. This gives rise to a problem of low productivity.

OBJECTS OF THE INVENTION

A primary object of this invention is to provide a ring shaping apparatus capable of shaping a workpiece with a high degree of roundness, which is achieved by arranging a pair of backup rollers in rotatable contact with peripheral surfaces of the workpiece under a constant pressure, the backup rollers being interlocked for synchronous movement. Such an apparatus does not require a separate sizing process at all, and is particularly effective for shaping a workpiece having a large diameter.

Another object of this invention is to provide a ring shaping apparatus capable of shaping a workpiece with a high degree of roundness, which is achieved by driving a shaping roller and a support roller independently of each other, and applying rotational torque to the workpiece from both the shaping roller and a mandrel, the rotation of the support roller being controlled in accordance with the rotation of the shaping roller.

A further object of this invention is to provide a ring shaping apparatus capable of improving the durability of the mandrel, which is achieved by eliminating slipping between the mandrel and support roller owing to the independent drive feature noted above.

Other objects of this invention will be apparent from the following description of a preferred embodiment.

BRIEF DESCRIPTION OF THE DRAWINGS

The drawings show an embodiment of this invention, in which.

DESCRIPTION OF THE PREFERRED EMBODIMENT

Figure 1:
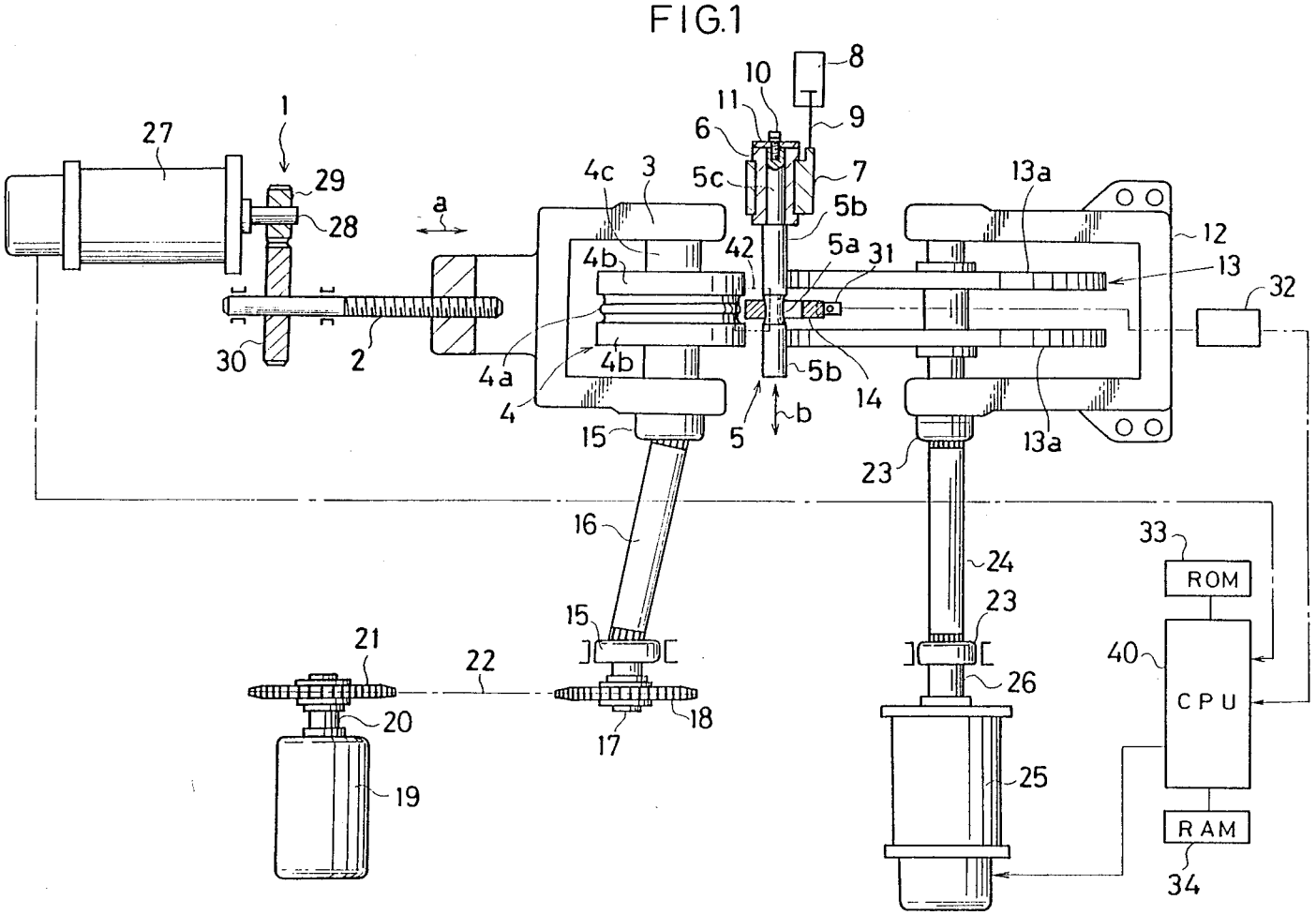
FIG. 1 is a system diagram of a ring shaping apparatus.

An embodiment of this invention will be described in detail hereinafter with reference to the drawings.

The illustrated ring shaping apparatus comprises a pressing device 1 including a screw 2, and a U-shaped movable frame 3 which is linearly reciprocable along a guide not shown. The movable frame 3 rotatably supports a shaping roller 4.

The shaping roller 4 defines a ring shaping portion **4*a* in an axially middle position and limiting surfaces 4*b* in axially opposite positions on its peripheral wall. The shaping roller 4 further includes a roller shaft 4*c***.

A mandrel 5 is provided to be movable toward and away from the shaping roller 4. The mandrel 5 is also movable in a direction of arrow b perpendicular to the reciprocating direction of the movable frame 3 which is indicated by arrow a.

This mandrel 5 defines a ring shaping portion **5*a* in opposed relationship with the ring shaping portion 4*a* of the shaping roller 4, and limiting surfaces 5*b* on opposite sides of the ring shaping portion 5*a*. The mandrel 5 is rotatably attached at an end shaft portion 5*c* to a slide block 7 through a metal piece 6. A mandrel moving cylinder 8 is provided which includes a piston rod 9 connected to the slide block 7**.

The end shaft portion **5*c* of the mandrel 5 is fixed at an end face thereof to a back plate 11 by a bolt 10. The mandrel 5 can be changed by removing the bolt 10**.

The ring shaping apparatus further comprises a U-shaped stationary frame 12 rotatably supporting a support roller 13.

The support roller 13 defines contact surfaces **13*a* at positions opposed to the limiting surfaces 4*b* of the shaping roller 4. These contact surfaces 13*a* are in contact with the limiting surfaces 5*b* of the mandrel 5 from behind the mandrel 5**.

A workpiece 14 in ring form is shaped by cold rolling between the ring shaping portion 4a of shaping roller 4 and the ring shaping portion 5a of mandrel 5.

Figure 2:
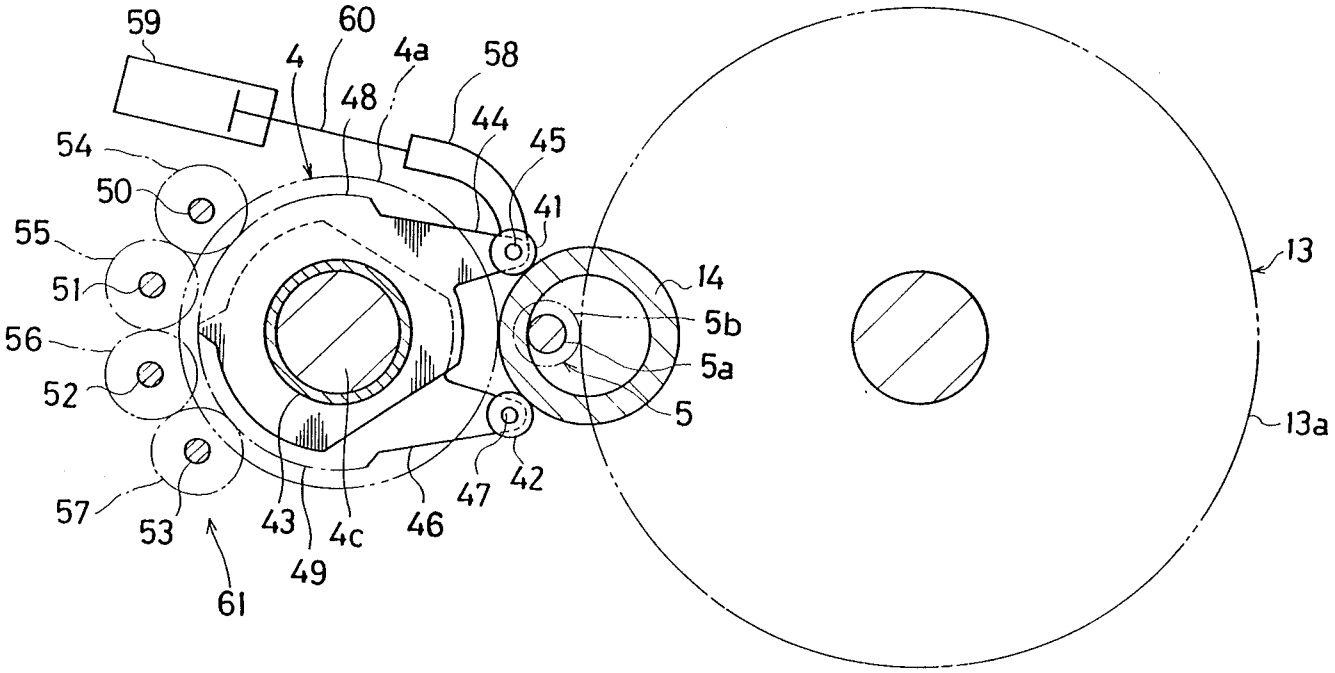
FIG. 2 is a plan view of a principal portion of the ring shaping apparatus.

The three components, namely the shaping roller 4, mandrel 5 and support roller 13, are rotatably supported and arranged on a plane and parallel to one another as also seen in FIG. 2.

The shaping roller 4 is connected to a connecting shaft 16 comprising a telescopic shaft having universal ball joints 15 at opposite ends thereof. The connecting shaft 16 is operatively connected at one end thereof to a sprocket shaft 17 carrying an input sprocket 18.

A motor 19 is provided for driving the shaping roller 4 independently. The motor 19 includes a rotary shaft 20 carrying an output sprocket 21, and a chain 22 is wound around the output sprocket 21 and the input sprocket 18. Thus, the torque of the motor 19 is transmitted to the shaping roller 4 through the rotary shaft 20, output sprocket 21, chain 22, input sprocket 18, sprocket shaft 17 and connecting shaft 16.

On the other hand, the support roller 13 is connected to a connecting shaft 24 having universal ball joints 23 at opposite ends thereof and incorporating a torque limiter not shown. The connecting shaft 24 is operatively connected at one end thereof to an output shaft 26 of a first servomotor 25. Thus, the torque of the first servomotor 25 is transmitted to the support roller 13 through the output shaft 26 and connecting shaft 24.

The pressing device 1 includes a drive gear 29 mounted on an output shaft 28 of a second servomotor 27, and a driven gear 30 mounted on the screw 2 and in constant mesh with the drive gear 29. The torque of the second servomotor 27 is transmitted to the screw through the gears 29 and 30. The resulting rotation of the screw 2 causes the movable frame 3 to move back and forth.

A contact sensor 31 is provided for contacting a position of the outer periphery of the workpiece 14, which position moves outwardly with an increase in the diameter of the workpiece 14 resulting from a rolling operation. The sensor 31 inputs a detection signal to a CPU 40 through an encoder 32.

In response to inputs from the second servomotor 27 and encoder 32, the CPU 40 controls the mandrel moving cylinder 8, motor 19, second servomotor 25 and a hydraulic cylinder 59 to be described later, on the basis of a program stored in a ROM 33. A RAM 34 is for storing various data which are set out hereinafter.

The encoder 32 comprises an absolute type rotary encoder, and encodes information on the workpiece diameter received from the contact sensor 31 for input to the CPU 40.

Assuming that $N_1$ represents the rotational rate of the shaping roller 4 and $N_2$ the rotational rate of the support roller 13, the following equation is established:

$$N_2 = N_1 \times \frac{D_1}{Do} \times \frac{Di}{D_4} \times \frac{D_3}{D_2}$$

anywhere $D_1$ is the diameter of the ring shaping portion 4a of shaping roller 4, $D_2$ is the diameter of the contact surfaces 13a of support roller 13, $D_3$ is the diameter of the ring shaping portion 5a of mandrel 5, D4 is the diameter of the limiting surfaces 5b of mandrel 5, Di is an inside diameter of the workpiece 14, and Do is an outside diameter of the workpiece 14.

The RAM 34 stores various data corresponding to the above $N_1$, $D_1$, $D_2$, $D_3$ and $D_4$ As shown in FIG. 2, the outer peripheral surfaces of the workpiece 14 are contacted by a pair of backup rollers 41 and 42 under a constant pressure. The backup rollers 41 and 42 are spaced from each other such that the rollers 41 and 42 form an equal angle with a line extending between the axes of the roller shaft 4c and mandrel 5.

One of the backup rollers 41 comprises a bearing fitted on an axis 45 extending from a first arm 44 pivotably attached to the roller shaft 4c through a spacer 43. Similarly, the other backup roller 42 comprises a bearing fitted on an axis 47 extending from a second arm 46 pivotably attached to the roller shaft 4c through the spacer 43.

The first arm 44 defines a first gear 48 on an arcuate surface thereof adjacent the screw 2, and the second arm 46 defines a second gear 49 on an arcuate surface thereof adjacent the screw 2.

The movable frame 3 supports gear shafts 50, 51, 52 and 53 respectively carrying a third gear 54, a fourth gear 55, a fifth gear 56 and a sixth gear 57 in mesh with one another. The third gear 54 is meshed with the first arcuate gear 48 while the sixth gear 57 is meshed with the second arcuate gear 49.

Further, the first arm 44 is connected, at an undersurface of the position at which the axis 45 is disposed, through a link 58 to a piston rod 60 of the hydraulic cylinder 59. Thus, the hydraulic cylinder 59 applies a constant pressing force to the backup rollers 41 and 42, with the elements 44–57 constituting an interlocking mechanism 61 for synchronously actuating the backup rollers 41 and 42 to follow variations in the diameter of the workpiece 14.

The important point here is that the two backup rollers 41 and 42 are operable in perfect symmetry about a line extending through the axes of the roller shaft 4c and a shaft to which the support roller 13 is secured. It is of course possible to dispense with the fourth gear 55 and fifth gear 56 and place the third gear 54 and sixth gear 57 in direct mesh with each other.

The illustrated embodiment has the construction as described above. How this embodiment operates will be described next.

The hydraulic cylinder 59 is operated beforehand to synchronously retract the two backup rollers 41 and 42 to positions away from the outer peripheral surfaces of the workpiece. The workpiece 14 is fed by a workpiece feeder, not shown, to a position between the shaping roller 4 and the support roller 13. Then the CPU 40 causes the mandrel moving cylinder 8 to advance from a standby position to a shaping position as shown in FIG. 1, whereby the mandrel 5 extends through a bore defined in the workpiece 14, bringing the ring shaping portion 5a to a position opposed to the ring shaping portion 4a of the shaping roller 4 across the workpiece 14.

Next, the CPU 40 drives the motor 19 to rotate the shaping roller 4, and the first servomotor 25 to rotate the support roller 13 and mandrel 5 under control.

Thereafter, the CPU 40 drives the second servomotor 27 to move, by means of the screw 2, the shaping roller 4 toward the support roller 13. The CPU 40 also drives the hydraulic cylinder 59 to synchronously advance the two backup rollers 41 and 42 to the peripheral surfaces of the workpiece 14 to apply a constant pressure uniformly over the peripheral surfaces of the workpiece 14.

The above operation places the ring shaping portion 4a of the shaping roller 4 in contact with the outer periphery of the workpiece 14 thereby to rotate the workpiece 14.

Figure 4:
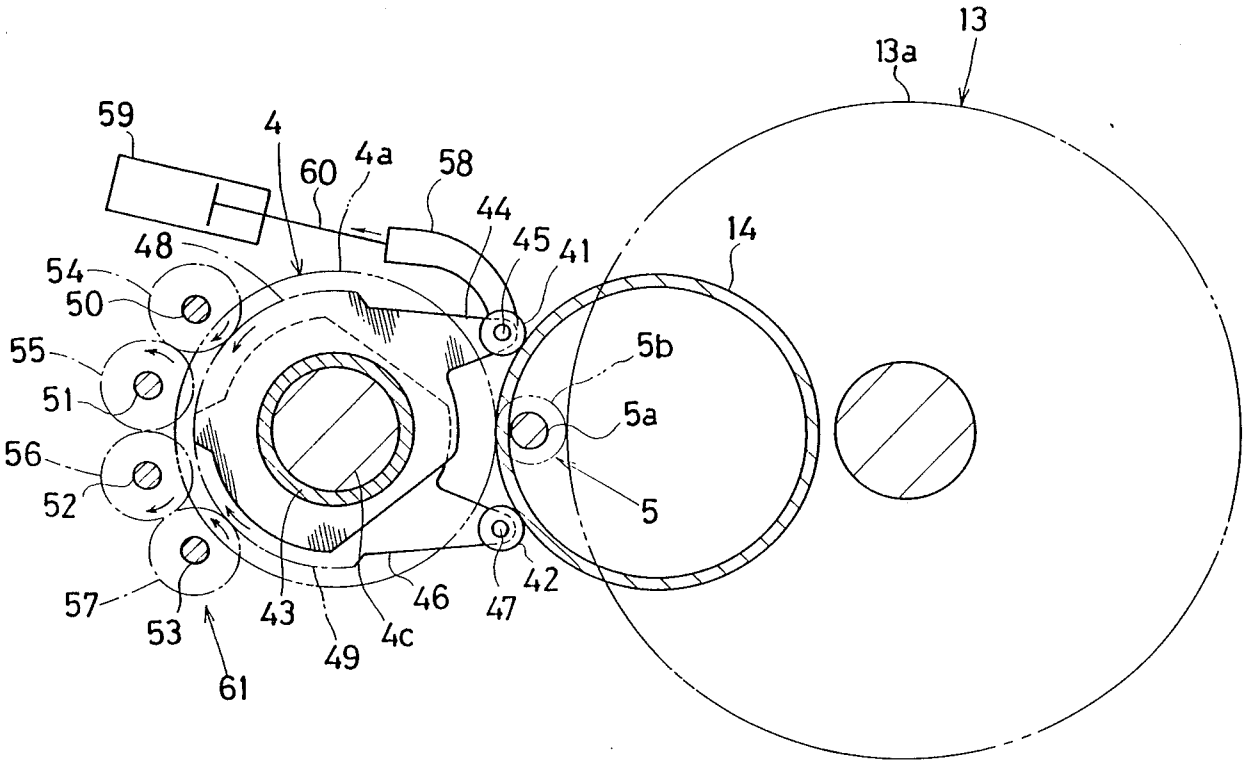
FIG. 4 is a plan view of the principal portion of the apparatus at the finishing time of a cold rolling operation.
Figure 5:
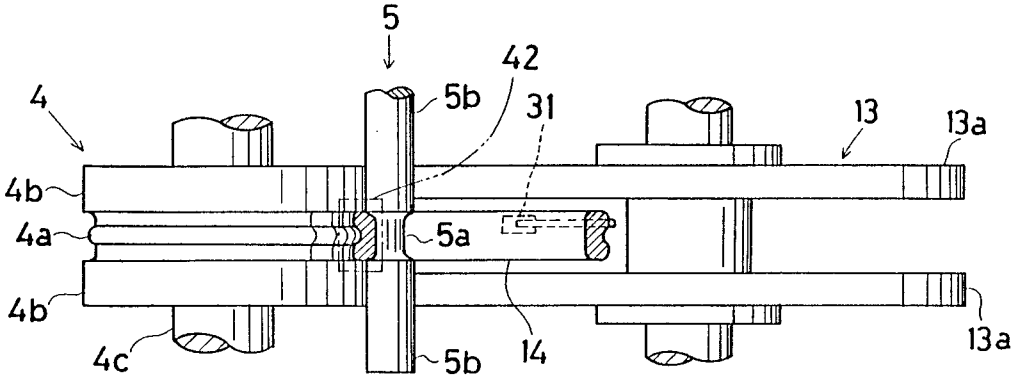
FIG. 5 is a side view of the principal portion at the finishing time of the cold rolling operation.

As the shaping roller 4 presses further, the workpiece 14 is rolled out in rotation by the ring shaping portion 4a of the shaping roller 4 and the ring shaping portion 5a of the mandrel 5. Ultimately the workpiece 14 is rolled into a shape as shown in FIGS. 4 and 5.

Figure 3:
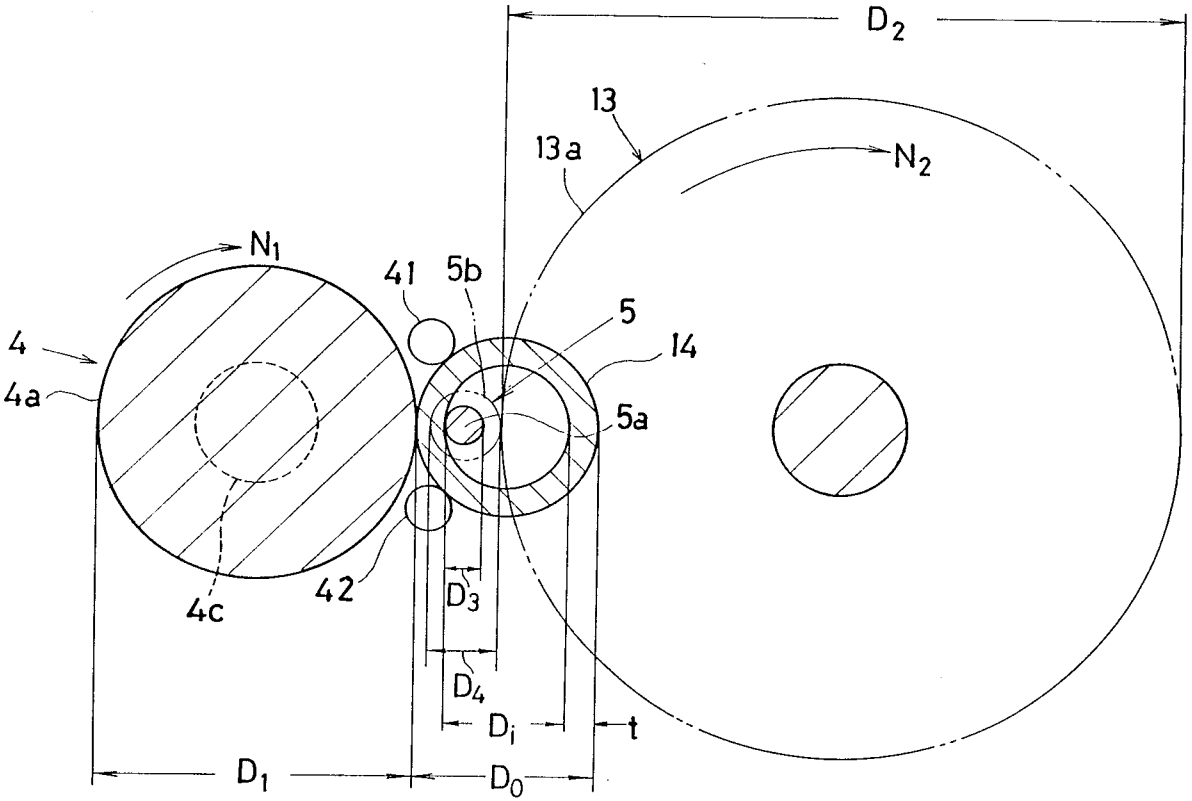
FIG. 3 is an explanatory view for illustrating a relationship in diameter and rotational rate among three rotation elements and a workpiece.

With progress of the rolling operation from start to finish, the value of Di/Do increases by degrees to the vicinity of 1. The CPU 40 carries out operations for a thickness t and the outside diameter Do of the workpiece 14 shown in FIG. 3 on the basis of a workpiece diameter measurement signal received from the contact sensor 31 and encoder 32 and a pressing amount signal (screw feed signal) from the second servomotor 27, and derives Di/Do (Di = Do − 2t) from the results of the operations. Thereafter, the CPU 40 controls the rotational rate of the first servomotor 25 to agree with the equation;

$$N_2 = N_1 \times \frac{D_1}{Do} \times \frac{Di}{D_4} \times \frac{D_3}{D_2}$$

Consequently, as the diameter of the workpiece 14 changes, the rotational rate $N_2$ of the support roller 13 varies in accordance with the above equation and in a corresponding relationship with the rotational rate $N_1$ of the shaping roller 4. At the same time, the workpiece 14 receives torque from both the shaping roller 4 and the mandrel 5. This feature provides the advantage of preventing elongation of the workpiece tangentially of the roller 4 and realizing workpiece shaping with high precision as to roundness.

As the diameter of the workpiece 14 gradually increases from the size shown in FIG. 2 to the size shown in FIG. 4, the workpiece 14 presses the piston rod 60 of the hydraulic cylinder 59 towards its head. Further, the first to sixth gears 48, 49, 54, 55, 56 and 57 rotate in directions indicated by arrows to maintain the two backup rollers 41 and 42 in the synchronously operating relationship. This enables the two backup rollers 41 and 42 to constantly operate in perfect symmetry about the line extending between the axes of the shaping roller shaft 4c and the shaft of the support roller 13. Consequently, the two back-up rollers 41 and 42 apply an equal pressing force to the workpiece 14 all the time, which promotes the high degree of roundness. Thus the workpiece shaping need not be followed by a sizing process any longer.

Since the shaping roller 4 is independently driven by the motor 19 and the support roller 13 by the first servomotor 25, the workpiece 14 receives torque both from the shaping roller 4 and from the mandrel 5 driven by the support roller 13. As a result, there is no possibility of slipping between the mandrel 5 and the support roller 13. This feature provides the advantage of improving durability of the mandrel 5.

Even when the shaping roller 4 or other component becomes worn after repeated rolling operations or when a shaping roller having a different diameter is used for shaping a workpiece having a different diameter, the rotational rates $N_1$ and $N_2$ of the shaping roller 4 and the support roller 13 are variable under numerical control in accordance with the foregoing equation. Consequently, a satisfactory shaping precision is assured for such situations also.

In addition, the servomotors 25 and 27 involve small inertia and have excellent followup characteristics, and therefore their rotational rates are controllable with high precision. Further, since the numerical control is effected in the absolute mode in which the original position of the mechanism is memorized as the start of the program, the numerical control is resumed reliably even after power is cut off once. This feature greatly facilitates setup changes.

The foregoing embodiment has been described in relation to formation of the inner race of a bearing. However, the same single apparatus may of course be made available for shaping many different objects in ring form such as the outer race or the pillow of a bearing as well as a cage, a sleeve and other automobile parts by employing corresponding mandrels and shaping rollers.

The motor 19 in the described embodiment may be replaced with a servomotor. Then both the rotational rates $N_1$ and $N_2$ may be varied under control to realize the numerical control with even higher precision.

The first drive source referred to in the claim corresponds to the motor 19 in the foregoing embodiment. Similarly, the second drive source corresponds to the first servomotor 25, the control means to the CPU 40, and the interlocking means to the interlocking mechanism 61 including the gears 48, 49, 54, 55, 56 and 57. However, the scope of the invention is not limited to the described embodiment.

For example, a ball screw is recommended as the screw 2.

The ring shaping apparatus as described above may of course be used for eliminating unevenness of a forged ring and for enlarging the diameter of a ring formed by press working.

The mandrel 5 is, of course, rotatably supported at opposite ends thereof during the operations noted above.

I claim:

1. A ring shaping apparatus comprising a rotatable shaping roller defining a ring shaping portion in an axially middle peripheral portion thereof;

a rotatable mandrel opposed to and movable toward and away from said shaping roller and defining a ring shaping portion in an axially middle portion thereof and having limiting surfaces at opposite ends of said ring shaping portion at the periphery thereof;

a rotatable support roller defining contact surfaces for contacting said limiting surfaces of said mandrel, said shaping roller, said mandrel and said support roller being rotatably supported in a plane and parallel to each other, wherein a generally ring shaped work piece is disposed between said mandrel and said shaping roller to be shaped into a ring having desired dimensions;

a first drive means for rotating said shaping roller;

a second drive means for rotating said support roller;

means for measuring the outside diameter of said ring during shaping operation;

control means, connected to said means for measuring, for controlling the rotational speed of said support roller in response to variations in diameter of said ring and in accordance with the rotational speed of said shaping roller;

a pair of backup rollers supported alongside said shaping roller to be in rotatable contact with the peripheral surface of said ring and under constant pressure; and interlocking means for synchronously actuating said pair of backup rollers to follow the variations in diameter of said ring.

* * * * *